US008631951B1

(12) United States Patent
Daugherty, Jr.

(10) Patent No.: US 8,631,951 B1
(45) Date of Patent: Jan. 21, 2014

(54) CORNCOB HOLDER FIELD

(76) Inventor: James Daugherty, Jr., Claremont, IL (US)

( * ) Notice: Subject to any disclaimer, the term of this patent is extended or adjusted under 35 U.S.C. 154(b) by 414 days.

(21) Appl. No.: 13/104,054

(22) Filed: May 10, 2011

(51) Int. Cl.
*A47G 21/00* (2006.01)

(52) U.S. Cl.
USPC ..... 211/85.4; 294/5

(58) Field of Classification Search
USPC ..... 211/13.1, 70.7, 85.4, 125; 248/27.8, 248/346.01; 294/5; 99/419, 421 V; D11/117; D7/683
See application file for complete search history.

(56) References Cited

U.S. PATENT DOCUMENTS

| | | | | |
|---|---|---|---|---|
| 513,146 | A | 1/1894 | Richberg | |
| 886,510 | A | 5/1908 | Huguet | |
| 1,801,653 | A | 4/1931 | Berry | |
| 2,257,505 | A | 9/1941 | Lichter | |
| D207,108 | S | 3/1967 | Heuck | |
| D268,723 | S | 4/1983 | Wolff | |
| D306,114 | S * | 2/1990 | Moll | D7/683 |
| 5,088,782 | A | 2/1992 | Scott | |
| D331,525 | S * | 12/1992 | Anderson | D7/683 |
| 5,566,997 | A | 10/1996 | Lin | |
| D418,025 | S | 12/1999 | Peterson | |
| 6,270,132 | B1 * | 8/2001 | Kretschmer | 294/5 |
| D470,729 | S * | 2/2003 | Kotsonis | D7/683 |
| 7,124,901 | B2 * | 10/2006 | Stoupa | 211/85.4 |
| D618,969 | S * | 7/2010 | Di Bitonto et al. | D7/637 |
| 2009/0261606 | A1 * | 10/2009 | Butterfield | 294/5 |
| 2012/0097575 | A1 * | 4/2012 | Abel et al. | 206/576 |

* cited by examiner

*Primary Examiner* — Joshua Rodden
(74) *Attorney, Agent, or Firm* — Kyle Fletcher

(57) ABSTRACT

The corncob holder field is a set including a plurality of corncob holders, and a device resembling rows of cornstalks. The corncob holders resemble mini ears of corn and each include a pair of pins used to pierce each end of an ear of corn in order to hold the ear when consuming. The pins of the corncob holders are inserted into pin holes located on the cornstalks so as to provide a means of storage when not in use. Each cornstalk located on the device can store a pair of corncob holders, and when storing said corncob holders shall resemble a cornstalk in which ears of corn are sprouting there from.

19 Claims, 2 Drawing Sheets

CORNCOB HOLDER FIELD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of corncob holders, more specifically, a decorative corncob field that holds a plurality of sets of corncob holders.

B. Discussion of the Prior Art

As will be discussed immediately below, no prior art discloses a set including a plurality of pairs of corncob holders that when not in use are stored on a device that resembles rows of cornstalks; wherein the corncob holders resemble small ears of corn and each include a pair of pins that are inserted into an end of an ear of corn for use in consuming the kernels of corn upon said ear; wherein the device for storing the corncob holders resembles a plurality of cornstalks that include pin holders designed to support corncob holders thereon, and when so stored shall resemble ears of corn sprouting from a cornstalk.

The Lichter patent (U.S. Pat. No. 2,257,505) discloses a corncob holder. However, the corncob holder is not stored when not in use on a device that resembles rows of corn stalks, which are specifically adapted to store a pair of corncob holders.

The Lin patent (U.S. Pat. No. 5,566,997) discloses a skewer for gripping a corncob. However, the skewer is not stored on a device that resembles a corn field when not in use, and resembles a cob of corn sprouting from a corn stalk.

The Huguet et al. patent (U.S. Pat. No. 886,510) discloses a corncob holder. Again, the skewer is not a part of a kit that includes a device for storage of the skewer when not in use.

The Berry et al. patent (U.S. Pat. No. 1,801,653) discloses a utensil for serving corncobs. However, the utensil is not a part of a set that stores the utensil on a device resembling rows of cornstalks, and in which each utensil itself resembles an ear of corn.

The Richberg patent (U.S. Pat. No. 513,146) discloses cutlery for holding a corncob or other vegetable item. Again, the cutlery is not a part of a set that stores the cutlery on a device resembling rows of cornstalks, and in which each item of cutlery itself resembles an ear of corn.

The Scott patent (U.S. Pat. No. 5,088,782) discloses a corn cob holder and method. Again, the corn cob holder is not a part of a set that stores the holders on a device resembling rows of cornstalks, and in which each corn cob holder itself resembles an ear of corn.

The Hueck et al. patent (U.S. Pat. No. Des. 207,108) illustrates a design for a food holder, which does not depict a set with means of storing the food holder when not in use, and which resembles rows of cornstalks.

While the above-described devices fulfill their respective and particular objects and requirements, they do not describe a set including a plurality of pairs of corncob holders that when not in use are stored on a device that resembles rows of cornstalks; wherein the corncob holders resemble small ears of corn and each include a pair of pins that are inserted into an end of an ear of corn for use in consuming the kernels of corn upon said ear; wherein the device for storing the corncob holders resembles a plurality of cornstalks that include pin holders designed to support corncob holders thereon, and when so stored shall resemble ears of corn sprouting from a cornstalk. In this regard, the corncob holder field departs from the conventional concepts and designs of the prior art.

SUMMARY OF THE INVENTION

The corncob holder field is a set including a plurality of corncob holders, and a device resembling rows of cornstalks. The corncob holders resemble mini ears of corn and each include a pair of pins used to pierce each end of an ear of corn in order to hold said ear when consuming. The pins of the corncob holders are inserted into pin holes located on the cornstalks so as to provide a means of storage when not in use. Each cornstalk located on the device can store a pair of corncob holders, and when storing said corncob holders shall resemble a cornstalk in which ears of corn are sprouting there from.

An object of the invention is to provide a set that stores and organizes pairs of corncob holders.

A further object of the invention is to provide a set that is decorative and resembles rows of cornstalks.

A further object of the invention is to provide a plurality of corn holders that resemble mini ears of corn, which when inserted onto the cornstalks shall resemble a cornstalk having ears of corn sprouting there from.

A further object of the invention is to provide a set that can be placed atop a dinner table or a kitchen counter to provide ease of access and/or means of organizing said corncob holders.

These together with additional objects, features and advantages of the corncob holder field will be readily apparent to those of ordinary skill in the art upon reading the following detailed description of presently preferred, but nonetheless illustrative, embodiments of the corncob holder field when taken in conjunction with the accompanying drawings.

In this respect, before explaining the current embodiments of the corncob holder field in detail, it is to be understood that the corncob holder field is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the corncob holder field.

It is therefore important that the claims be regarded as including such equivalent construction insofar as they do not depart from the spirit and scope of the corncob holder field. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
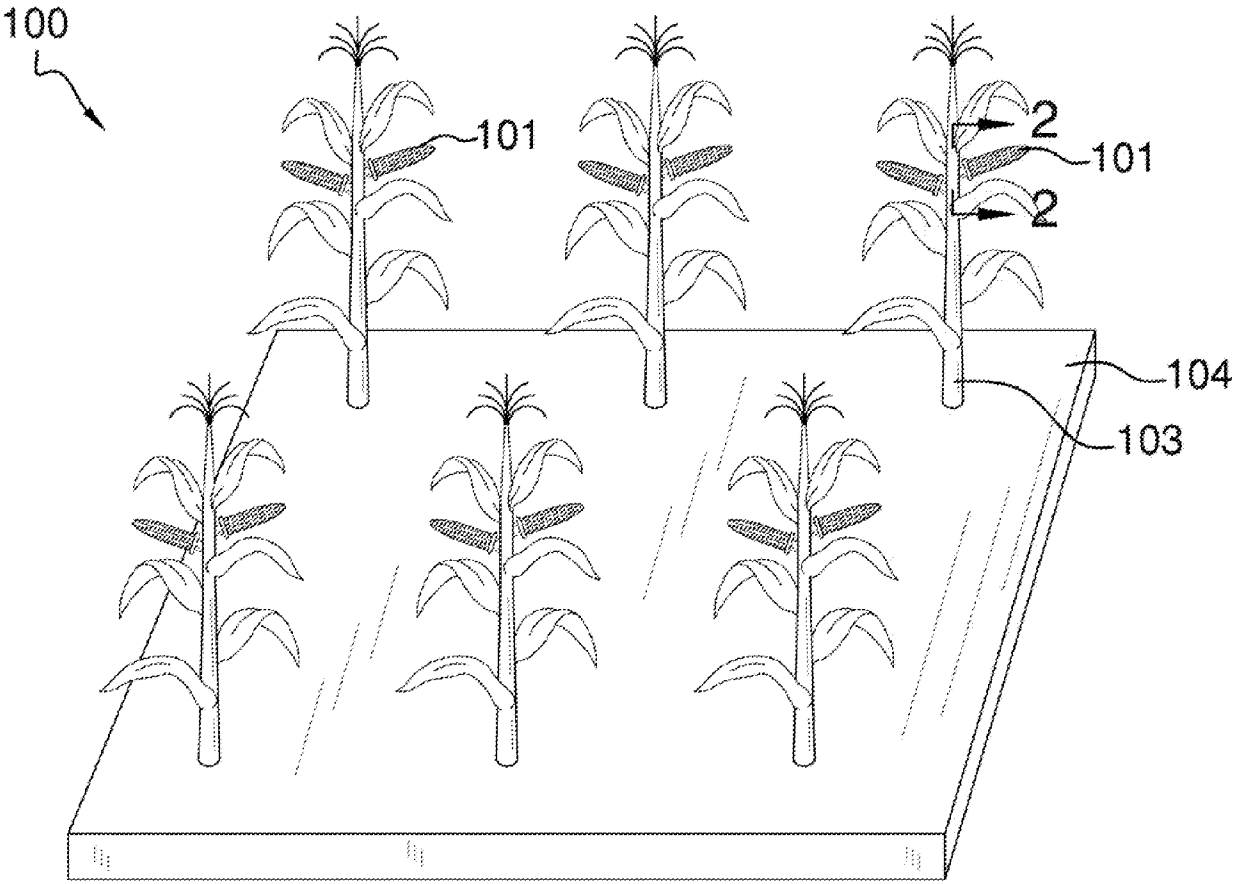
FIG. 1 illustrates a perspective view of the set in which the pairs of corncob holders are stored upon the cornstalks.
Figure 3:
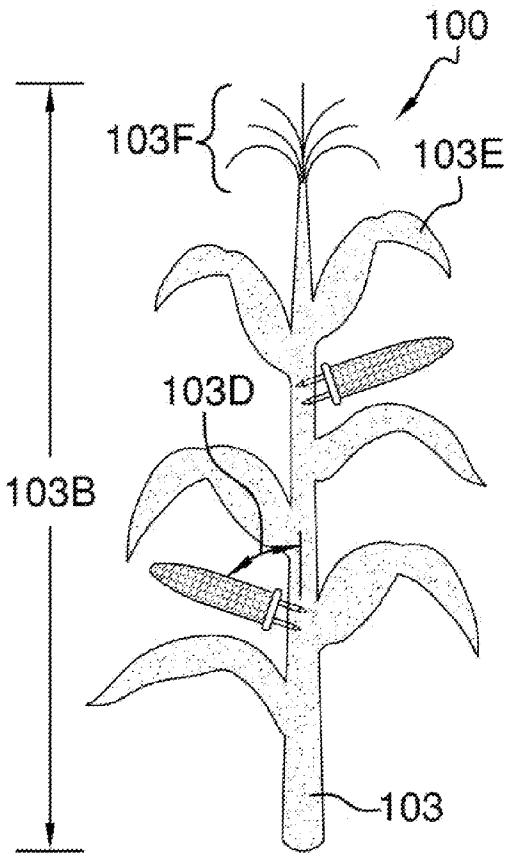
FIG. 3 illustrates a single cornstalk with a pair of corncob holders stored thereon.
Figure 2:
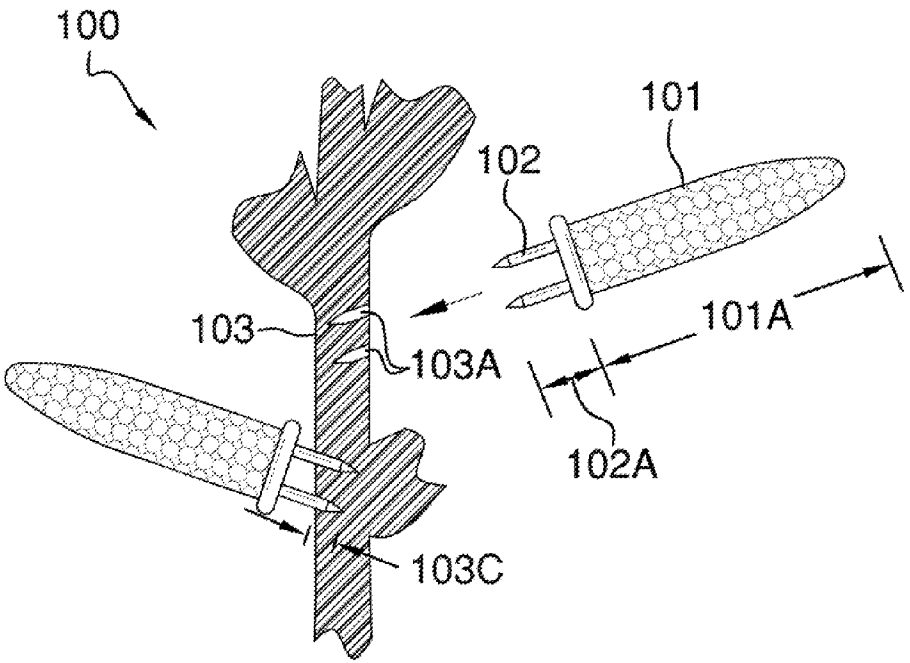
FIG. 2 illustrates a cross-sectional view of the corncob holder field along line 2-2 in FIG. 1, and illustrating insertion of a corncob holder into pin holes situated on the respective cornstalk.

Detailed reference will now be made to the preferred embodiment of the present invention, examples of which are illustrated in FIGS. 1-3. A corncob holder field 100 (hereinafter invention) includes a plurality of corncob holders 101.

The corncob holders 101, ideally, come in pairs so that each corncob holder 101 may be inserted into an end of an ear of corn. Each corncob holder 101 resembles a mini ear of corn, and includes a pair of pins 102 that extend along a first end. The corncob holders 101 are made of a material comprising a plastic, wood, metal, or ceramic. The corncob holders 101 may be painted yellow or other colors associated with a real ear of corn so as to resemble an ear of corn.

The corncob holders 101 are small in size and may have an overall length 101A of not less than ½ inch. The pins 102 are defined by a length 102A of not less than ¼ inch.

The invention 100 includes a plurality of cornstalks 103 that are mounted to a base 104. The base 104 is simply a board onto which the cornstalks 103 extend vertically. The cornstalks 103 are arranged to form a pattern resembling rows of cornstalks, which is analogous to standard farming techniques associated with growing corn.

The cornstalks 103 include pin holes 103A at various places on the cornstalk 103. The pin holes 103A enable pins 102 of a corncob holder 101 to be inserted therein, and stored when not in use. It is a main benefit of the invention 100 to provide a means of storing and organizing corncob holders 101 when not in use, as placement of corncob holders 101 in a loose drawer may result in unintended loss or misplacement.

The pin holes 103A have a 103C depth equal to or less than the length 102A of the pins 102. More particularly, the pin holes 103A are spaced to correspond to the pair of pins 102 located on the corncob holder 101. The pin holes 103A are set at an angle 103D with respect to the cornstalk 103 such that the corncob holders 101 are stored at an angle analogous to an actual cornstalk. The pin holes 103A are also staggered along a length 103B of the cornstalk 103.

It shall be noted that each cornstalk 103 can store and support two corncob holders 101 such that each cornstalk 103 shall be assigned a pair of corncob holders 101, which is the customary number used when supporting an ear of corn. Referring to FIG. 1, the cornstalks 103 each support a pair of corncob holders 101 thereon so that placement of the invention 100 on a table provides each person seated at a table an assigned cornstalk 103.

The cornstalks 103 are made of a material comprising a plastic, wood, ceramic, or metal. The cornstalks 103 are each defined by the height 103B, which ranges from at least 2 inches to not more than 8 inches. The cornstalks 103 each resemble an actual cornstalk including leafs 103E and tassels 103F extending atop the cornstalk 103. It shall be noted that upon placement of the corncob holders 101 on the cornstalk 103, that the cornstalks 103 shall resemble a cornstalk with sprouting ears of corn located thereon, which is a decorative appeal to the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various, embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A corncob holder field comprising:

a plurality of corncob holders each including a pair of pins used to support an end of an ear of corn;

a plurality of holders, wherein each holder resembles a cornstalk, wherein the holders are organized on a base to resemble a field of corn;

wherein each holder includes pin holes such that the corncob holders may be stored thereon when not in use to resemble a cornstalk with sprouting ears of corn.

2. The corncob holder field as described in claim 1 wherein the corncob holders resemble mini ears of corn.

3. The corncob holder field as described in claim 2, wherein the corncob holders are painted yellow.

4. The corncob holder field as described in claim 2, wherein the corncob holders have an overall length of not less than ½ inch.

5. The corncob holder field as described in claim 2, wherein the pins are defined by a length of not less than ¼ inch.

6. The corncob holder field as described in claim 1 wherein the corncob holders and holders are made of a material comprising plastic, wood, metal, or ceramic.

7. The corncob holder field as described in claim 5, wherein the pin holes of the holder have a depth equal to or less than the length of the pins; wherein the pin holes are spaced to correspond with the pair of pins on the corncob holder.

8. The corncob holder field as described in claim 7, wherein each holder stores a pair of saiD corncob holders.

9. The corncob holder field as described in claim 7, wherein the pin holes are staggered along a height of the holder; wherein the pin holes are set an angle with respect to the holder.

10. The corncob holder field as described in claim 9 wherein the height of the holder ranges from not less than 2 inches to not more than 8 inches.

11. The corncob holder field as described in claim 1 wherein the holder includes leafs and tassels.

12. A corncob holder field comprising:

a plurality of pairs of corncob holders that each resemble a mini ear of corn; wherein the corncob holders each include a pair of pins used to support an end of an ear of corn;

a plurality of holders, wherein each holder resembles a cornstalk, wherein the holders are organized on a base to resemble a field of corn;

wherein each holder stores one of said pairs of corncob holders;

wherein the holders include leafs and tassels so as to resemble an actual cornstalk;

wherein each holder includes pin holes such that the corncob holders may be stored thereon when not in use to resemble a cornstalk with sprouting ears of corn.

13. The corncob holder field as described in claim 12 wherein the corncob holders are painted yellow.

14. The corncob holder field as described in claim 12 wherein the corncob holders have an overall length of not less than ½ inch.

15. The corncob holder field as described in claim 12 wherein the pins are defined by a length of not less than ¼ inch.

16. The corncob holder field as described in claim 12 wherein the corncob holders and holders are made of a material comprising plastic, wood, metal, or ceramic.

17. The corncob holder field as described in claim 16 wherein the pin holes of the holder have a depth equal to or less than the length of the pins; wherein the pin holes are spaced to correspond with the pair of pins on the corncob holder.

18. The corncob holder field as described in claim 12 wherein the pin holes are staggered along a height of the holder; wherein the pin holes are set an angle with respect to the holder.

19. The corncob holder field as described in claim 12 wherein the height of the holder ranges from not less than 2 inches to not more than 8 inches.

* * * * *